United States Patent [19]

Reuter et al.

[11] Patent Number: 4,590,983

[45] Date of Patent: May 27, 1986

[54] PRECISION VACUUM MELTING AND CASTING FURNACE WITH A MELTING CHAMBER AND A CASTING CHAMBER

[75] Inventors: Wolfgang Reuter, Niddatal; Manfred Hartmann, Gelnhausen, both of Fed. Rep. of Germany

[73] Assignee: Leybold-Heraeus GmbH, Cologne, Fed. Rep. of Germany

[21] Appl. No.: 727,023

[22] Filed: Apr. 25, 1985

[30] Foreign Application Priority Data

May 12, 1984 [DE] Fed. Rep. of Germany ..... 3417731

[51] Int. Cl.[4] ..... B22D 27/15; B22D 37/00

[52] U.S. Cl. ..... 164/258; 164/335; 251/228; 137/330

[58] Field of Search ..... 164/253, 258, 335, 61; 251/228, 252; 137/330

[56] References Cited

U.S. PATENT DOCUMENTS

| | | | |
|---|---|---|---|
| 3,519,061 | 7/1970 | Dunlop | 164/258 |
| 3,845,808 | 11/1974 | Higginbotham et al. | 164/258 |
| 3,897,815 | 8/1975 | Smashey | 164/127 |
| 3,916,992 | 11/1975 | Boyadjieff et al. | 251/228 |
| 4,328,947 | 5/1982 | Reimpell et al. | 251/228 |
| 4,541,475 | 9/1985 | Goddard et al. | 164/253 |

*Primary Examiner*—Gene P. Crosby
*Assistant Examiner*—Samuel M. Heinrich
*Attorney, Agent, or Firm*—Max Fogiel

[57] ABSTRACT

A precision vacuum melting and casting furnace with a melting chamber containing a melting device. A casting chamber is positioned below the melting chamber. The casting chamber can be raised, lowered, and swung out to the side. The casting chamber communicates with the melting chamber through a valve chamber, which contains a vacuum valve. The valve chamber accommodates a lift platform for raising the mold up under the melting device. The casting chamber has a lifting mechanism, and the vacuum valve has an activating rod. In order to essentially simplify precise alignment of the different movable parts and to convert an existing conventional casting furnace into a furnace in accordance with the present invention, a hollow vertical shaft is attached to the valve chamber. The rod that activates the vacuum valve extends vacuum-tight through the shaft. A sleeve that guides the casting chamber is positioned at the outer surface of the shaft.

5 Claims, 5 Drawing Figures

PRECISION VACUUM MELTING AND CASTING FURNACE WITH A MELTING CHAMBER AND A CASTING CHAMBER

BACKGROUND OF THE INVENTION

The present invention relates to a precision vacuum melting and casting furnace with a melting chamber containing a melting device, with a casting chamber that is positioned below the melting chamber, that can be raised, lowered, and swung out to the side, that communicates with the melting chamber through a valve chamber, which contains a vacuum valve, and that accommodates a lift platform for raising the mold up under the melting device, with a lifting mechanism for the casting chamber, and with an activating rod for the vacuum valve.

A vacuum furnace of this generic type is known from GB Patent No. 1 349 099. The casting chamber and lift platform for the mold are part of a carrousel that at least one more casting chamber and lift platform are associated with. The lifting mechanism for the casting chamber is a pivoting column that can be raised and lowered, that is mounted in part of the furnace structure next to the housing, and that must be precisely positioned in order to seal it off from the furnace housing effectively enough. The drive rods for the vacuum valves positioned between the total of three furnace chambers are at a right angle to the various lifting mechanisms. The overall design of this vacuum furnace is complicated and it takes up considerable space. Furthermore, the known solution does not make it possible for instance to refit an existing melting chamber and melting device with an appropriate extension.

Another known vacuum furnace of the same overall type but simpler in design is the present applicant's Model IS 2/I. The casting chamber is swung out to the side and the preliminarily heated molds placed in it. A pivoting column is again mounted at the side of the furnace structure to pivot the casting chamber out and must be carefully adjusted in relation to the sealing surface between the valve chamber and the casting chamber. The drive rod for the vacuum valve is also at a right angle to the pivoting column. It is also difficult in this case to convert an existing conventional furnace into a precision casting furnace because the drive mechanisms for the various moving parts of the furnace are difficult to adjust.

SUMMARY OF THE INVENTION

The object of the present invention is to provide a vacuum furnace of the type initially described, in which it will be essentially simple to precisely align the different movable parts and which can in particular be constructed by converting an existing conventional casting furnace.

This object is attained in accordance with the invention in that a hollow vertical shaft is attached to the valve chamber, the rod that activates the vacuum valve extends vacuum-tight through the shaft, and a sleeve that guides the casting chamber is positioned at the outer surface of the shaft.

The valve chamber and built-on hollow shaft in the object of the invention together constitute a reference system that is simple to adjust with high precision. Thus, the hollow shaft can in particular be precisely aligned perpendicular to two horizontal walls that demarcate the valve chamber. Since the hollow shaft simultaneously ensures precise radial alignment of the valve plate and casting chamber, the various sealing pairs will always be exactly positioned horizontally. The valve chamber and hollow shaft can in particular be easily manufactured as a subassembly and later added to a conventional casting furnace. Since all guidance functions are assumed by the hollow shaft, the overall device can be factory delivered already adjusted to the melting chamber with no need for complicated assembly and adjustment.

One especially practical embodiment of the invention provides at the bottom of the rod that activates the vacuum valve a camming slot that transmits a rotation to the rod along part of its vertical travel for activating the vacuum valve.

This camming slot makes it possible with a single drive mechanism to pivot the valve plate until it is aligned with the appropriate valve seat and then force the plate against the seat with no need for a separate rotation.

In another embodiment of the invention the seat of the vacuum valve is mounted on the wall that demarcates the top of the valve chamber and the seat can be replaced.

Some preferred embodiments of the invention will now be described with reference to the attached drawings, wherein

BRIEF DESCRIPTON OF THE DRAWINGS

FIG. 1 is a vertical section through the essential components of the object of the invention, FIG. 2 is a side view of the cam with the camming slot that guides the valve, FIG. 3 is a section along the line III—III in FIG. 1 in the vicinity of the cam illustrated in FIG. 2, FIG. 4 is a partial larger-scale section through the area indicated by the circle IV in FIG. 1, and FIG. 5 is a top view of the valve chamber.

DETAILED DESCRIPTION OF THE PREFERRED EMBODIMENTS

Figure 1:
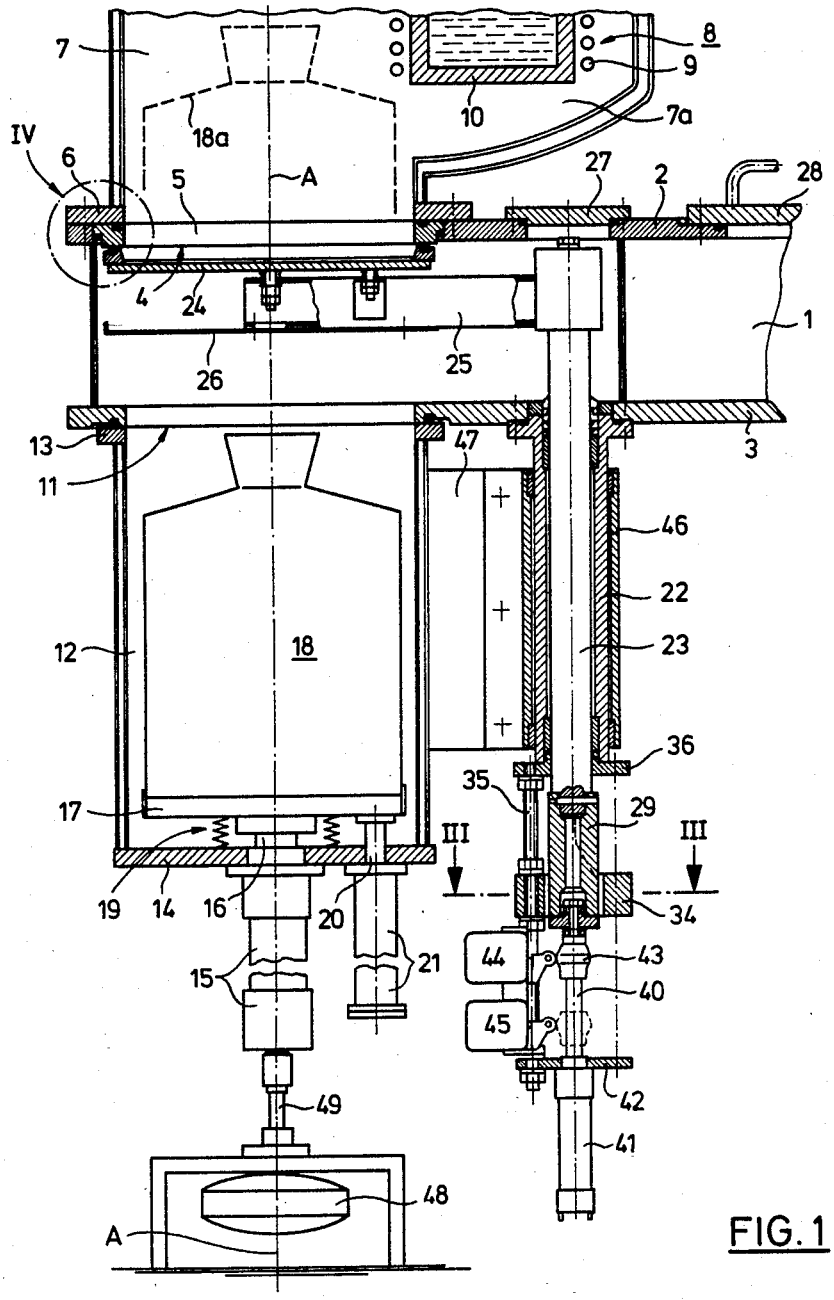

FIG. 1 illustrates a precision vacuum melting and casting furnace in accordance with the invention. Its central portion is a valve chamber 1 demarcated at the top by a wall 2 and at the bottom by another wall 3. The bottom of upper wall 2 has a valve seat 4 consisting of the bottom of a ring 5 that is fastened in the wall and can be replaced. A melting chamber 7 containing a melting device 8 is fastened to valve chamber 1 with an annular flange 6. The melting device can for example by a crucible 10 that is heated by an induction coil 9 and can be tilted around a horizontal axis, not illustrated. The molten contents of crucible 10 can be poured out essentially parallel to the vertical axis A—A of the furnace. A stationary crucible with an aperture in the bottom and positioned concentric with axis A—A can also be employed instead of a tilting crucible. When a tilting crucible 10 is employed, melting chamber 7 will have a lateral bay *7a* to accommodate it.

Lower wall 3 also has a valve seat 11 concentric with axis A—A. A casting chamber 12 can be forced against valve seat 11. Casting chamber 12 has an annular flange 13 in the vicinity of its aperture and is closed off at the bottom by a floor 14. A lifting mechanism 15 is attached to floor 14. Lifting mechanism 15 has a piston rod 16. A lift platform 17 for moving a mold 18 up and down is attached to the top of piston rod 16. A bellows 19 ensures a reliable seal between lift platform 17 and floor 14. To prevent lift platform 17 from rotating in relation to casting chamber 12, the platform has a guide rod 20 that passes vacuum-tight through a guide cylinder 21. Mold 18 can be raised on lift platform 17 into an upper, filling, position 18*a* represented by the broken lines.

A hollow vertical shaft 22 is attached to lower wall 3. A rod 23, which activates a vacuum valve 24, extends through hollow shaft 22. Vacuum valve 24 can be raised, lowered, and pivoted on a boom 25 in valve chamber 1. A radiation screen 26 is mounted on boom 25 to protect the closed vacuum valve 24 from excess heat from the preheated mold 18.

An axial motion on the part of activating rod 23 will force vacuum valve 24 against or lift it from valve seat 4. A separate or superimposed rotation of activating rod 23, however, will also swing it into a position in which mold 18 is raised into filling position 18*a*. A charge of casting material can be melted in melting chamber 7, and casting chamber 12 can be simultaneously charged as long as vacuum valve 24 remains closed during that time. Upper wall 2 has two lids 27 and 28 to provide maintenance and installation access.

Figure 2:
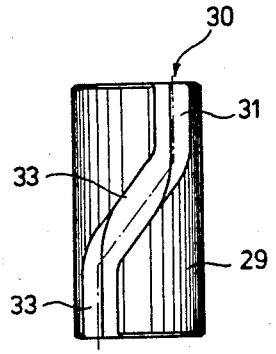

To allow a combination of lift and rotation, activating rod 23 has a cylindrical cam 29 at the bottom. The details of the cam will now be described with reference to FIG. 2. Cam 29 has a camming slot 30 composed of two axially parallel segments 31 and 33 offset along its circumference and connected by a sloping segment 32. Segment 32 slopes at an angle of 45° for example to an axially parallel generating line on cam 29. The components of the motion that closes the valve plate consist of a straight lifting motion, rotation to below the valve seat, and linear force against the seat.

Figure 3:
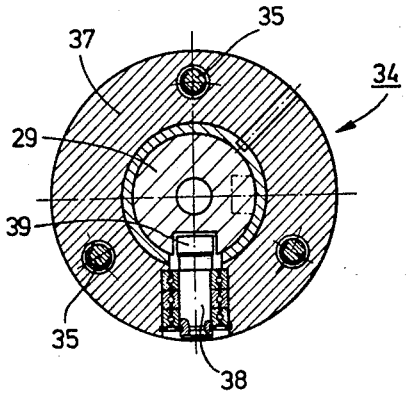

Cam 29 is mounted in a roller bearing 34, illustrated in FIG. 3, and suspended with three spacers 35 from an annular flange 36 that is connected rotationally stationary to hollow shaft 22. Roller bearing 34 consists of a ring 37 that has a roller 38 mounted in it with roller bearings that are not described in detail herein. The axis of rotation of roller 38 is radial. Roller 38 has a cylindrical head 39 that engages the camming slot 30 in cam 29. Cam 29 in this embodiment of course carries out when it moves vertically a composite lifting and rotating motion in accordance with the three-dimensional course of camming slot 30 and produces the desired motion of vacuum valve 24. Since the spatial structure of camming slot 30 is designed to offset axially parallel segments 31 and 33 90°, activating rod 23 will rotate 90° as it travels though its total stroke.

To make activating rod 23 move vertically, cam 29 is connected to the piston rod of a lift cylinder 41 that rests on a flange plate 42 on extensions in spacers 35. A rotationally symmetrical lifter 43 is attached to head 40 and operates in conjunction with one or the other of two limit switches 44 and 45 as desired, constituting two position detectors that communicate the limiting positions of valve seat 4 to controls, not illustrated. Limit switches 44 and 45 are attached to one of spacers 35 or its extension.

Stuffing boxes, not illustrated, are positioned inside the top and bottom of hollow shaft 22 to seal it vacuum-tight. A guide sleeve 46 is positioned against the cylindrical outer surface of hollow shaft 22 and connected to casting chamber 12 by a radial connecting bracket 47. Guide sleeve 46 can, in addition to rotating, also execute a longitudinal motion along hollow shaft 22. Thus, once casting chamber 12 has been pivoted into the position illustrated in FIG. 1, annular flange 13 can be forced against valve seat 11. For this purpose there is in the vicinity of the axis A—A of the furnace a lifting mechanism 48 with a piston rod 49 that engages the bottom face of lifting mechanism 15 once casting chamber 12 has been pivoted in. Activating lifting mechanism 48 raises the overall lifting mechanism 15 along with casting chamber 12 and lift platform 17, and casting chamber 12 is connected to valve chamber 1 vacuum-tight.

Figure 4:
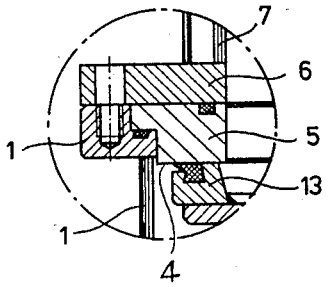

FIG. 4 illustrates on a larger scale how ring 5 is inserted in the upper wall 2 of valve chamber 1. Sealing is accomplished with several gaskets that are not illustrated and are in themselves state of the art.

Figure 5:
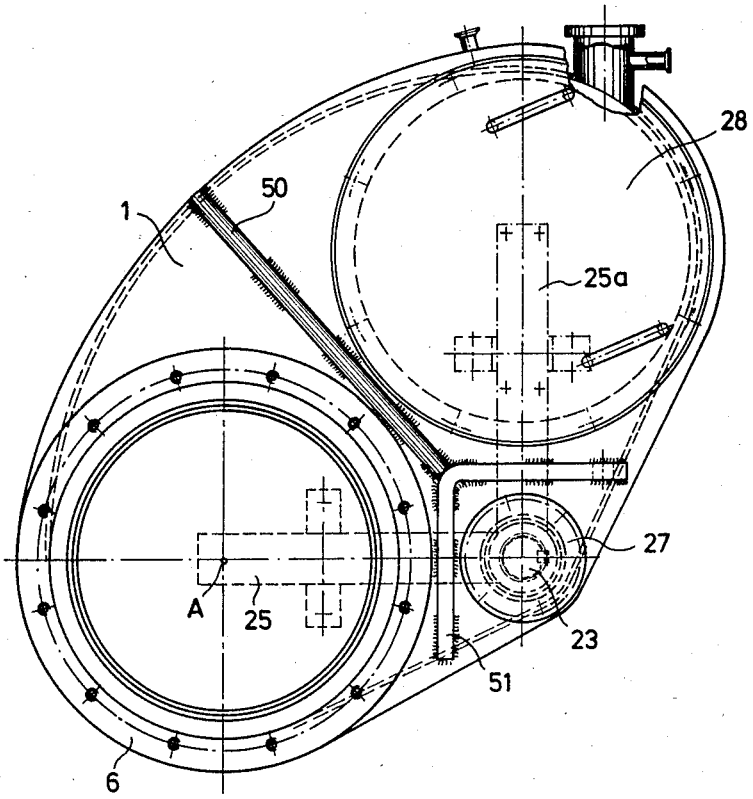

Further details of valve chamber 1 will be evident from FIG. 5. As projected onto a horizontal plane, valve chamber 1 is more or less in the shape of the sector of a circle with a cross-section large enough for vacuum valve 24 to swing out of the left and forward position into the right and rear position. Boom 25 will then move out of the position indicated by the broken line into the position 25*a* indicated by the dot-and-dash line. It will also be evident that upper wall 2 is reinforced with respect to atmospheric pressure by ribs 50 or 51. Vacuum valve 24 is accordingly designed along the lines of a shuttle and its details are in themselves state of the art.

The present specification and claims are of course intended solely as illustrative of one or more potential embodiments of the invention and should not be construed as limiting it in any way. The invention may accordingly be adapted and modified in many ways without deviating from the theory behind it or exceeding its scope of application.

We claim:

1. In a precision vacuum melting and casting furnace, an arrangement comprising: a melting chamber containing melting means; a casting chamber positioned below said melting chamber and being raisable, lowerable, and pivotable outward to a side; a valve chamber having a vacuum valve; said casting chamber communicating with said melting chamber through said valve chamber; a lift platform for raising a mold up under said melting means and located in said casting chamber; lifting means for said casting chamber; an activating rod for said vacuum valve; a hollow vertical shaft attached to said valve chamber; said rod activating said vacuum valve extending vacuum-tight through said shaft; and sleeve means guiding said casting chamber and being positioned at an outer surface of said shaft.

2. Furnace as defined in claim 1, including means at the bottom of said rod for transmitting a rotation to the rod along part of its vertical travel.

3. Furnace as defined in claim 1, wherein said vacuum valve has a seat mounted on a wall bordering the top of said valve chamber, said seat being replaceable.

4. Furnace as defined in claim 2, wherein said means for transmitting a rotation to the rod along part of its vertical travel comprises cam means.

5. Furnace as defined in claim 4, wherein said cam means comprises a cam with a camming slot.

* * * * *